United States Patent [19]

Bianchi

[11] Patent Number: 4,894,982

[45] Date of Patent: Jan. 23, 1990

[54] TWISTING MACHINE PARTICULARLY FOR TWISTED THREADS

[75] Inventor: Franco Bianchi, Milan, Italy

[73] Assignee: Officine Meccaniche Riva S.r.l., Como, Italy

[21] Appl. No.: 253,071

[22] Filed: Oct. 4, 1988

[30] Foreign Application Priority Data

Oct. 13, 1987 [IT] Italy ..... 22249 A/87

[51] Int. Cl.[4] ..... D01H 7/00; D02G 3/28

[52] U.S. Cl. ..... 57/58.36; 57/58.3; 57/58.52; 57/58.86

[58] Field of Search ..... 57/58.37, 58.38, 92–94, 57/50.52, 58.86

[56] References Cited

U.S. PATENT DOCUMENTS 2,914,903 12/1959 Klein et al. ..... 57/58.36 X
3,041,815 7/1962 Klein ..... 57/58.3
3,286,450 11/1966 Vibber ..... 57/58.3
3,340,686 9/1967 Vibber ..... 57/58.36
4,102,117 7/1978 Dornberger ..... 57/58.3 X
4,592,195 6/1986 Charbonnier ..... 57/58.36

*Primary Examiner*—John Petrakes
*Attorney, Agent, or Firm*—Notaro & Michalos

[57] ABSTRACT

A twisting machine, which yields a twisted thread at an unusually constant twist value, comprises within a main frame first and second yarn paths converging toward a gathering point of respective yarns from a first reel carried on the main frame and a second reel carried on a spindle, a twisted thread path extending from the gathering point to a take-up reel driven rotatively by a roller, a flyer journalled in the main frame at the gathering point, and a capstan placed along the twisted thread path, and a positive mechanical drive for interconnecting rotatively the flyer, capstan, and roller directly with the spindle.

12 Claims, 2 Drawing Sheets

TWISTING MACHINE PARTICULARLY FOR TWISTED THREADS

FIELD AND BACKGROUND OF THE INVENTION

This invention relates to a twisting machine of a type which comprises, within a main frame, first and second yarn paths converging toward a yarn gathering point where the yarns are gathered as they are respectively supplied from a first pay-off reel carried on the main frame and a second pay-off reel carried on a spindle journalled in the main frame, a twisted thread path extending from said yarn gathering point to a take-up reel, a so-called flyer journalled in the main frame at the gathering point, and a so-called capstan feed in the thread path from the gathering point to the pick-up reel.

Twisting machines of the kind outlined above are well known and have been widely used for plying together two yarns into a twisted thread at the yarn gathering point, which thread is then wound around a suitable take-up reel as it is being formed at the gathering point.

With currently available twisting machines, the resulting thread lay tends to be more or less uneven, in that it may develop fluctuations in the amount of twist, due to slippage on the spindle, and hence to changes in the spindle-to-capstan speed ratio.

SUMMARY OF THE INVENTION

The problem that underlies this invention is to provide a twisting machine of the type specified above, which has such constructional and operational characteristics as to overcome the noted drawback which affects the prior art.

This problem is solved by a twisting machine as indicated being characterized in that it comprises a positive mechanical drive for rotatively coupling the flyer and capstan directly to the spindle.

Further features and the advantages of a twisting machine according to this invention will be more clearly understood from the following detailed description of a preferred embodiment thereof, to be taken by way of illustration and not of limitation with reference to the accompanying drawings.

Figure 1:
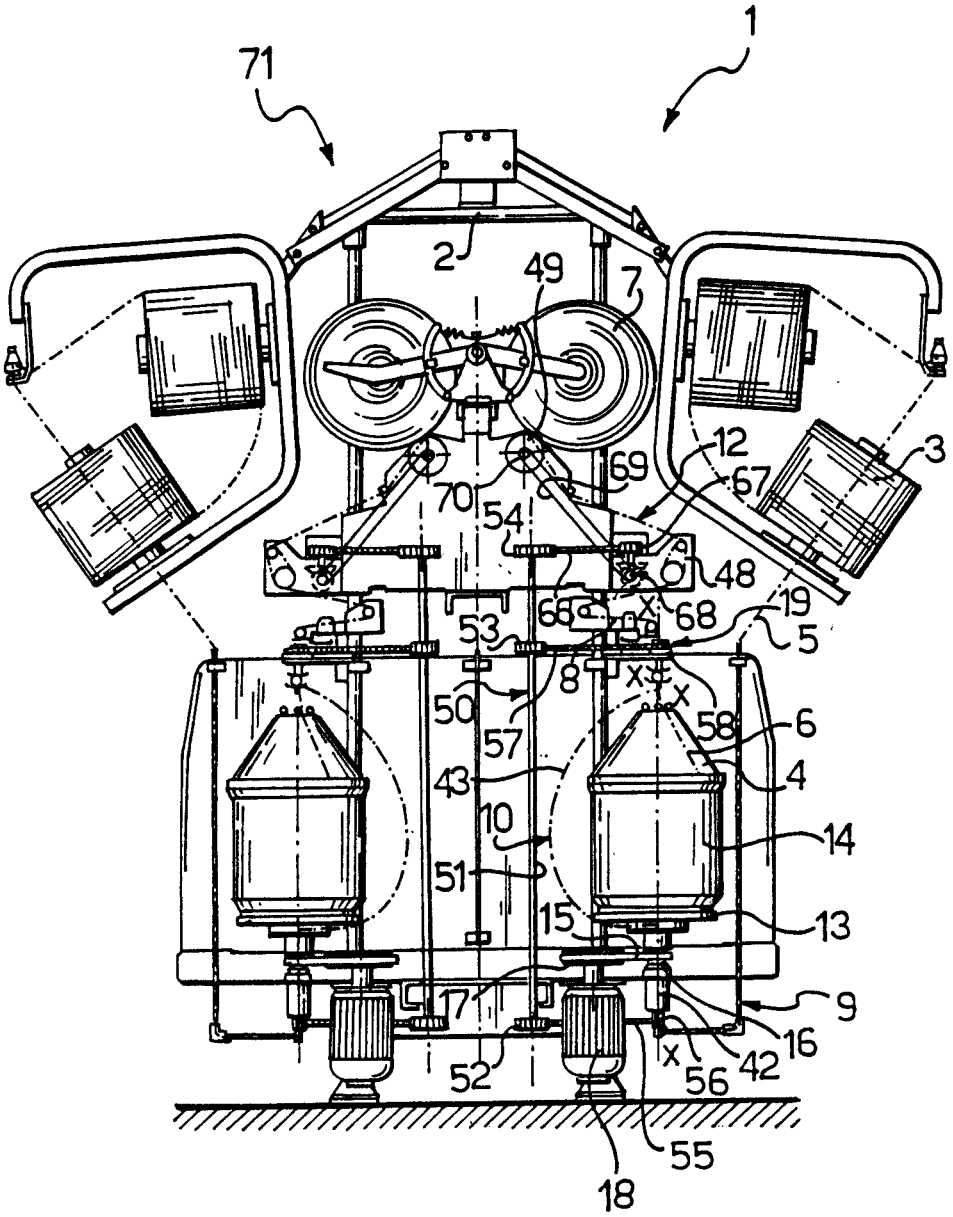
FIG. 1 is a schematic view of a twisting machine according to the invention.

With reference to the drawing views, the numeral 1 designates generally a twisting machine according to the invention.

DESCRIPTION OF THE PREFERRED EMBODIMENT

The twisting machine 1 comprises elements that are mounted to a main frame 2, including a first reel 3 and a second reel 4 loaded with respective yarns 5 and 6 to be plied together, and a take-up reel 7 for taking up a twisted thread 8.

First reel support means and take-up reel support means are connected to frame 2 for the respective reels.

Figure 2:
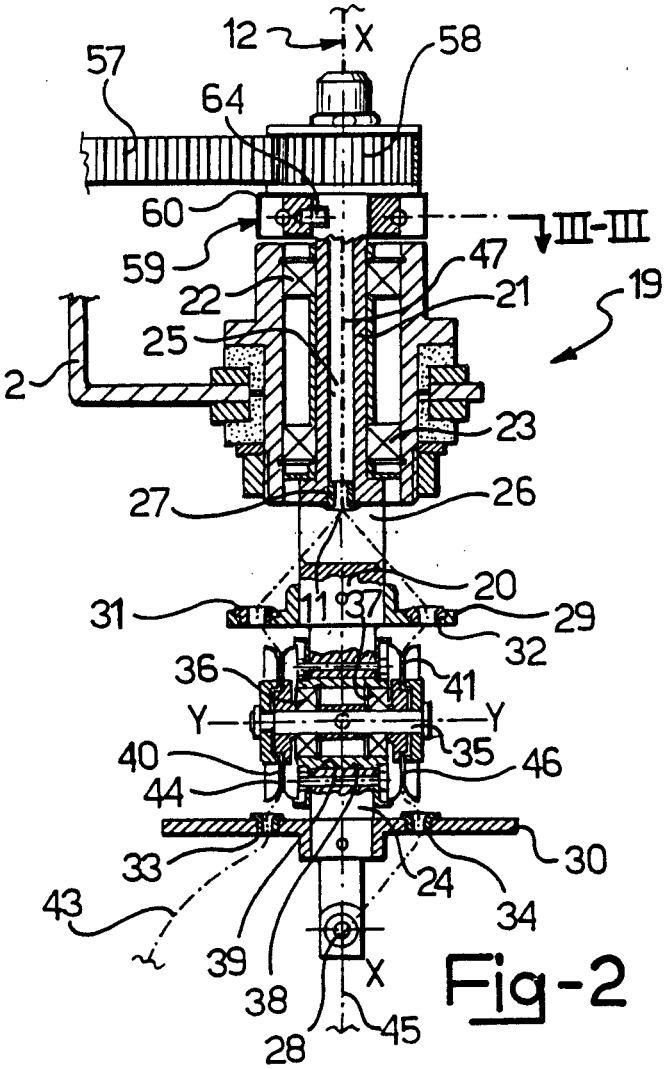
FIG. 2 is an enlarged scale, part-sectional view of a detail of the twisting machine of FIG. 1.

Respectively indicated at 9 and 10 are first and second portions of a first yarn path extending from the first reel 3 for the yarn 5, which is arranged to converge with yarn 6 from reel 4 toward a yarn gathering point, indicated at 11 in FIG. 2.

The reference numeral 12 denotes a thread path extending from the yarn gathering point 11 to the take-up reel 7 for the twisted thread 8.

The first reel 3 is carried on the main frame 2, and the yarn 5 is paid off it.

The second reel 4 is supported on a spindle 13 having a vertical axis X—X, carrying a reel holder bowl 14, and being journalled in the main frame 2. The reel 4 is retained inside the bowl 14 by conventional magnetic means.

The spindle 13 is driven rotatively from an electric motor 18 via a drive belt 15 stretched between two pulleys 16 and 17.

The twisting machine 1 comprises, at the gathering point 11, a mechanism 19 journalled in the main frame 2 and referred to as the flyer.

The mechanism or flyer 19 comprises a shaft 20 with an axis X—X, which has a first portion 21 provided with mutually set-apart bearings 22 and 23, whereby it is journalled to the main frame 2, and a second portion 24 jutting out toward the second reel 4.

The first portion 21 is made tubular by the provision of a coaxial bore 25 therein which opens with its bottom end into a throughgoing hole 26 formed across the shaft 20 between the first and second portions.

Provided at said bottom end is a yarn eye leader 27 at which the gathering point 11 substantially locates.

Provided at the bottom end of the second portion 24 is a yarn eye leader 28.

Keyed to the portion 24 of the shaft 20 in spaced-apart relationship are two disk plates, respectively an upper one 29 and a lower one 30.

Provided in the upper disk plate 29 are two yarn eye leaders 31 and 32. Likewise, two yarn eye leaders 33 and 34 are provided in the lower disk plate 30.

Supported rotatably on the portion 24 of the shaft 20 of the mechanism 19 is a pin shaft 35 having an axis Y—Y perpendicular to the axis X—X. In particular, the pin shaft 35 carries two bearings 36 and 37 in mutually spaced-apart relationship whereby it is supported rotatably within a bush 38 fitted into a throughgoing hole 39 formed across the second portion 24 at a location between the disk plates 29 and 30.

To the opposing ends of the pin shaft 35 there are keyed respective pulleys 40 and 41 which are identical to each other. By virtue of their keyed fit on the pin shaft, the two pulleys 40 and 41 can be rotated jointly.

The first yarn path portion 9 travelled by the yarn 5 from the reel 3 to the gathering point 11 has a section 42 through the spindle 13 and then forms, with a section 43 thereof, a bag or balloon (the term "balloon" being meant herein to define the revolution figure generated by the yarn and detectable by the eye, and rendering the more frequently used French term of "balloon") which extends from the spindle 13 to the eye 33, and past the eye 33 into a section 44 extending from the eye 33 to the eye 31 and given at least one turn around the pulley 40, to then go through the eye 31 and converge toward the yarn gathering point 11 as far as the eye 27. The second yarn path position 10 includes sections 43 and 44.

The second yarn path travelled by the yarn 6 from the reel 4 to the gathering point 11, has a section 45 which extends from the reel 4 to the eye 28, and runs then through and past the eye 34 into a section 46 extending from the eye 34 to the eye 32, it being given at least one turn around the pulley 41 and run through the eye 32 to also converge toward the yarn gathering point 11 at the eye 27.

The path 12 travelled by the twisted thread 8 extends from the yarn gathering point 11 to the take-up reel 7 and has a section 47 extending through the first portion 21 of the shaft 20, goes through a positive feed 48, referred to as the capstan, and finally reaches the take-up reel 7.

As for the take-up reel 7, this is driven rotatively by a roller 49 journalled in the main frame 2, with the reel arranged to bear on the periphery of the roller 49.

The twisting machine according to this invention includes a mechanical drive 50 which interconnects for joint rotation in a direct and positive manner the flyer 19, capstan 48, and take-up reel drive roller 49 with the spindle 13.

More specifically, the drive 50 comprises a vertical shaft 51 journalled in the main frame 2, to which three cogged pulleys 52, 53, and 54, defining lower, middle, and upper pulleys, respectively, are keyed.

The lower pulley 52 is positioned level with the spindle 13 and connected by a cogged belt 55 to a cogged pulley 56 keyed to the spindle 13.

The middle pulley 53 is positioned level with the flyer 19 and connected by a cogged belt 57 to a cogged pulley 58 which is mounted for idle rotation on the top end of the first portion 21 of the shaft 20 for the flyer 19.

A clutch 59 associated with the flyer 19 at an intermediate location to the pulley 58 and the remaining portion 21 of the shaft 20, is provided for making rotatively unitary the pulley 58 with the shaft 20, and hence, the flyer with the drive. It is arranged to be declutched when the flyer 19 is to be disengaged from the drive 50.

The clutch 59 is the centrifugal variety, it being disengaged on the centrifugal force attaining, as a result of a predetermined critical angular velocity having been reached, a predetermined suitable magnitude.

Figure 3:
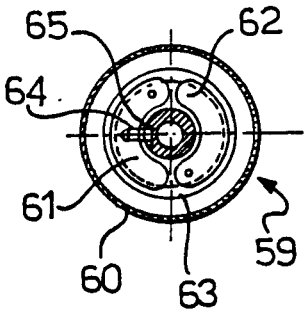
FIG. 3 is a sectional view taken through the machine detail in FIG. 2 along the line III—III.

More specifically, the clutch 59 includes a case 60, fast with the pulley 58, wherein two eccentric masses 62 and 61 are pivoted which are subjected to the centrifugal force against the bias of a restoring spring 63 embodied by a snap ring encircling said masses (FIG. 3).

A dog 64 is provided on the mass 61 and adapted to engage in a notch 65 formed in the portion 21 of the shaft 20 to make the pulley 58 and shaft 20 rotatively unitary.

The upper pulley 54 is positioned level with the capstan 48 and connected by a cogged belt 66 to a cogged pulley 67 associated with the capstan for driving it.

The drive 50 further includes a pulley 68 which is associated with the capstan and connected rotatively to the pulley 67 by a transmission, e.g. a bevel gear transmission, said pulley 68 being, in turn, connected via a cogged belt 69 to a cogged pulley 70 keyed to the roller 49.

The twisting machine 1 just described may be coupled, on a common main frame, to another twisting machine 71, quite similar to the former but being a mirror image thereof. Also, the two twisting machines, 1 and 71, could be laid beside quite similar pairs of twisting machines, to provide a cluster including up to several tens pairs all mounted on a common main frame, wherein each twisting machine forms an operatively independent unit.

The operation of the twisting machine 1 will be next described by making reference to starting, steady-state, and halting phases thereof.

At the start-up, the motor 18 will reach its rated rpm almost instantaneously, and the spindle 13 move, within a certain time period when the belt 15 slips, from standstill to steady-state rpm. The same applies to the flyer 19, capstan 48, and roller 49, which are all held rotatively rigid with the spindle by means of the drive 50.

As for the flyer 19, this is driven rotatively by the drive 50 until its speed rises from zero to the aforesaid predetermined angular velocity critical value at which the centrifugal force reaches a value whereby the clutch 59 is disengaged. From this time onwards, the mechanism 19 is rotated, up to its steady state rpm, rather than from the mechanical drive 50, from the balloon formed by the yarn 5 across its section 43. It should be noted that, with the clutch 59 in its disengaged condition, the flyer 19 is released angularly from the spindle 13, and that the balloon can take a slightly helical pattern in space, that is the required pattern for entraining the flyer 19.

On the steady state condition being reached, and regardless of any residual slippage of the belt 15, the flyer 19, capstan 48, and roller 49 will be all timed together. In particular, the spindle 13 and flyer 19 will turn at exactly the same rpm.

It should be noted that during steady-state operation, the yarns 5 and 6 will reach, on account of the at least one turn thereof around their respective pulleys 40 and 41, the same speed at their sections 44 and 46, thereby they get to the gathering point 11 at the same rate.

Thus, the pin shaft 35 is effective to balance the tensions on the yarns 5 and 6 by transmitting a supplementary torque to the pulley around which is wound the yarn inherently more tensioned at the expense of the pulley having the least tensioned yarn wound around it.

The twisting machine halting procedure is substantially the reverse of its starting procedure. In fact, after switching off the motor 15, the spindle 13, and hence the flyer 19, capstan 48, and drive roller 49 for the take-up reel 7 will all slow down gradually in timed relationship.

On the flyer 19 speed again crossing the critical speed value, the clutch 59 is engaged, owing to the spring bias overcoming the centrifugal force, and the flyer 19 is re-engaged with the drive 50 and, therefore, again made rotatively unitary with the spindle 13, and continues to rotate, despite the gradual collapsing of the balloon, until it is brought to a full stop in timed relationship with the spindle.

The main advantage of the twisting machine according to this invention resides in the constant value of the thread lay, attained irrespective of any fluctuations in the spindle speed by virtue of the timed rotary connection of all the twisting machine members to the spindle.

A further advantage of the twisting machine according to the invention is that its operation is nearly fully automatic, since the various members derive their motions from the spindle.

In particular, the inventive twisting machine ensures absolute uniformity of twist, even during the starting and halting phases.

Where a number of twisting machines are provided on a common main frame, the added advantage is secured that the threads from all the twisting machines carry all the same amount of twist, irrespective of the speeds at which the individual motors are run.

Another advantage of the twisting machine according to the invention is that the flyer carrying the yarn tension equalizing shaft is driven rotatively, while operating at steady-state speed, from the spindle itself via the balloon formed by the yarn.

A not least advantage of the twisting machine according to the invention is that it yields a thread, from two yarns made to converge to a gathering point, which has quite faultless characteristics, that is, optimum appearance and a high toughness, on account of the rates at which both yarns are led to the gathering point being strictly identical.

Understandably, to the twisting machine disclosed hereinabove a skilled person in the art may, for the purpose of meeting specific and contingent demands, apply numerous modifications and variations without departing from the true scope of the invention as set forth in the appended claims.

I claim:

1. A yarn twisting machine, comprising:

a main frame;

first reel support means connected to said frame for carrying a first pay-off reel of yarn;

a spindle journalled for rotation to said frame for carrying a second pay-off reel of yarn;

a flyer for engaging and twisting two yarns to each other at a gathering point to form a twisted thread, said flyer being journalled for rotation to said frame;

take-up reel support means connected to said frame for carrying a take-up reel for taking up twisted yarn from said flyer;

means defining a first path for yarn from said first reel support means to said gathering point;

means defining a second path for yarn from said spindle to said gathering point;

means defining a path for twisted thread from said gathering point to said take-up reel support means;

a capstan feed journalled for rotation to said frame in said path for twisted thread for positively feeding twisted thread from said gathering point to said take-up reel support means; and positive mechanical drive means interconnected between said capstan feed, said flyer and said spindle for positively rotating said capstan, said flyer and said spindle together at least during a start up period for the machine.

2. A yarn twisting machine according to claim 1 wherein said positive mechanical drive means comprises a clutch connected to said flyer for positively rotating said flyer during the start up period up to a selected velocity, and for disengaging said flyer from rotation of said capstan feed and spindle above the selected velocity.

3. A yarn twisting machine according to claim 2 wherein said clutch comprises a centrifugal clutch.

4. A yarn twisting machine according to claim 3 wherein said flyer comprises a flyer shaft mounted for rotation about a first axis, a pin shaft mounted for rotation to said flyer shaft about a second axis which is substantially transverse to said first axis, and a pair of pulleys connected to said pin shaft each for engagement with one of the yarns to be twisted in said flyer, u stream of said gathering point with respect to said fi and second paths for yarn.

5. A yarn twisting machine according to claim including a lower disc plate fixed to said flyer sh below said pulleys and an upper disc plate fixed to sa flyer shaft above said pulleys, each of said upper a lower disc plates carrying a pair yarn eyes, said fi path for yarn extending to one of said eyes of said low disc plate and said second path for yarn extending to t other of said eyes of said lower disc plate.

6. A yarn twisting machine according to claim wherein said flyer shaft comprises a first portion and second portion, a through bore extending through sa flyer shaft between said first and second portions, sa through bore being above said upper disc plate, sa first portion of said flyer shaft having an axial bo therethrough communicating with said through bore said gathering point, said axial bore defining part of sa path for twisted thread.

7. A yarn twisting machine according to claim wherein said positive mechanical drive means include drive pulley mounted for rotation to said first portion said shaft, said clutch being connected to said first pc tion of said shaft, and operatively engagable with sa drive pulley for rotation of said flyer shaft with rotati of said drive pulley.

8. A yarn twisting machine according to claim wherein said flyer comprises a flyer shaft mounted f rotation to said frame, a through bore extendi through said shaft in a direction substantially transver to an axis of said shaft, said flyer shaft having an axi bore therein extending to said through bore at sa gathering point, said axial bore defining part of said pa for twisted thread, and a disc plate fixed to said fly shaft on a side of said through bore opposite from sa gathering point, with a pair of yarn eyes in said di plate each for receiving one of the two yarns to twisted by said flyer.

9. A yarn twisting machine according to claim wherein said positive mechanical drive means co prises a clutch connected to said flyer shaft for engag ment and disengagement between said flyer, and sa capstan feed and spindle.

10. A yarn twisting machine according to claim including a pair of pulleys rotatably mounted to sa journal shaft each for engagement by one of the tv yarns.

11. A yarn twisting machine according to claim wherein said disc plate is positioned between said pu leys and said through bore, and including a second di plate with a pair of yarn eyes each for one of the tv yarns, said second disc plate being connected to sa flyer shaft on a side of said pulleys which is opposi from said first mentioned disc plate.

12. A yarn twisting machine according to claim including a pin shaft mounted for rotation to said fly shaft on an axis transverse to the axis of said flyer sha said pulleys being connected to said pin shaft for rot tion therewith.

* * * * *